US008336271B2

(12) United States Patent
Helmus

(10) Patent No.: US 8,336,271 B2
(45) **Date of Patent: *Dec. 25, 2012**

(54) FAN FILTER MOUNTING FRAME

(75) Inventor: Martin Helmus, Grandville, MI (US)

(73) Assignee: Mod-Tec, LLC, Grandville, MI (US)

( * ) Notice: Subject to any disclaimer, the term of this patent is extended or adjusted under 35 U.S.C. 154(b) by 721 days.

This patent is subject to a terminal disclaimer.

(21) Appl. No.: 12/419,786

(22) Filed: Apr. 7, 2009

(65) Prior Publication Data

US 2009/0249717 A1 Oct. 8, 2009

Related U.S. Application Data

(63) Continuation-in-part of application No. 11/378,419, filed on Mar. 17, 2006, now Pat. No. 7,513,086.

(51) Int. Cl.
*E04B 9/00* (2006.01)
*E04B 1/00* (2006.01)

(52) U.S. Cl. ..... 52/506.06; 52/506.01; 52/506.08; 52/506.07; 52/506.09; 248/343; 248/745.05

(58) Field of Classification Search ..... 52/745.05, 52/506.06, 506.07, 506.08, 506.09, 506.1, 52/39; 248/342–343; 454/187
See application file for complete search history.

(56) References Cited

U.S. PATENT DOCUMENTS

| | | | | |
|---|---|---|---|---|
| 3,708,927 | A * | 1/1973 | Cohen | 52/39 |
| 4,710,208 | A * | 12/1987 | Ziemer et al. | 55/355 |
| 4,937,994 | A * | 7/1990 | Ritter | 52/506.07 |
| 4,967,530 | A * | 11/1990 | Clunn | 52/506.08 |
| 4,986,050 | A * | 1/1991 | Brunetti et al. | 52/506.08 |
| 5,033,247 | A * | 7/1991 | Clunn | 52/506.08 |
| 5,279,632 | A * | 1/1994 | Decker et al. | 55/355 |
| 6,257,308 | B1 * | 7/2001 | Huang | 160/369 |
| 7,322,157 | B2 * | 1/2008 | Hang | 52/506.08 |
| 7,810,294 | B2 * | 10/2010 | Maley et al. | 52/506.06 |

* cited by examiner

*Primary Examiner* — Jeanette E. Chapman
(74) *Attorney, Agent, or Firm* — Waters & Associates; Donald J. Wallace

(57) ABSTRACT

The fan filter mounting frame is useful in installation of equipment in a cell of suspension grid systems when the equipment is passed through and is placed in a corner of the cell. The equipment is supported partially directly by the grid and partially indirectly by the grid through an adapting frame insert. The frame insert is connected between the equipment and the suspension grid system and may have two legs that meet at an apex, a first leg extending along a first grid rail and a second leg extending along an adjacent second grid rail. Each of the two legs also extends between its respective rail and the equipment, supporting the equipment on the respective suspension grid rails. Thus, the grid system may be in its design position or condition prior to and during placement and replacement of the equipment without disruption.

13 Claims, 13 Drawing Sheets

FAN FILTER MOUNTING FRAME

CROSS-REFERENCE TO RELATED APPLICATIONS

This application is based on and claims the priority date of Applicant's U.S. application Ser. No. 11/378,419, filed Mar. 17, 2006, and entitled FAN FILTER MOUNTING FRAME, now U.S. Pat. No. 7,513,086, issued Apr. 7, 2009, the disclosure of which is incorporated by reference.

BACKGROUND OF THE INVENTION

The invention relates to placement and support of equipment by ceiling suspension grid systems. More specifically, the invention is directed to supplemental framing that is adapted to mount the equipment on a suspension grid system, which grid is in place in its finished condition and without disrupting the grid system. The invention may further be said to be directed to relatively heavier equipment at least insofar as relatively lighter equipment is readily handled and manipulated in installation and maintenance.

Light duty ceiling grid systems and the like are known and useful for suspending various and relatively light equipment in a room, including ceiling tiles, some lighting fixtures, and some ventilation grills. Suspension frame systems include a series of parallel rail and cross rail components, which install to define a rectangular grid framework. Light duty grid frame systems and light weight equipment are relatively easily handled and manipulated in installation and maintenance. Some familiar light weight equipment may include lighting fixtures, ceiling tiles, ventilation grills, and the like. One who installs the relatively light equipment into a ceiling grid system may place and replace ceiling grid rail and cross rail components relatively easily while also manipulating the subject equipment into an installed position.

Relatively heavy mechanical units, including fans, filters, large lighting fixtures, and the like, are inherently more difficult to place and manipulate merely by their mass and physical size. The handling and placement of these cumbersome units includes an increase of risk for injury to the installer and risk of damage to the equipment. Thus, one may understand that a simplification of the installation of the heavier mechanical units is desirable and needed to reduce injury risk

BRIEF SUMMARY OF THE INVENTION

Accordingly, a fan filter mounting frame of the invention simplifies installation of heavier equipment with suspension grid systems by allowing the grid system to be in its design position or condition prior to placement of the equipment. Further, the equipment is placed without disturbing or manipulating the suspension grid system. The equipment is in part supported directly by the grid system and is in part supported indirectly by the grid system through an adapting frame insert. The adapting frame insert is connected between the equipment and the suspension grid system.

In one aspect of the invention, the insert has two legs that meet at an apex, with a first leg extending along a first suspension grid system rail or cross rail and a second leg extending along an adjacent second suspension grid system cross rail or rail. Each of the two legs further extends between its respective rail and the equipment, supporting the equipment on the respective suspension grid rails and cross rails.

These and other features and benefits of the invention will be recognized by one having ordinary skill in the art and by those who practice the invention, from this disclosure, including the specification, the claims, and the drawing figures.

DETAILED DESCRIPTION

Figure 1:
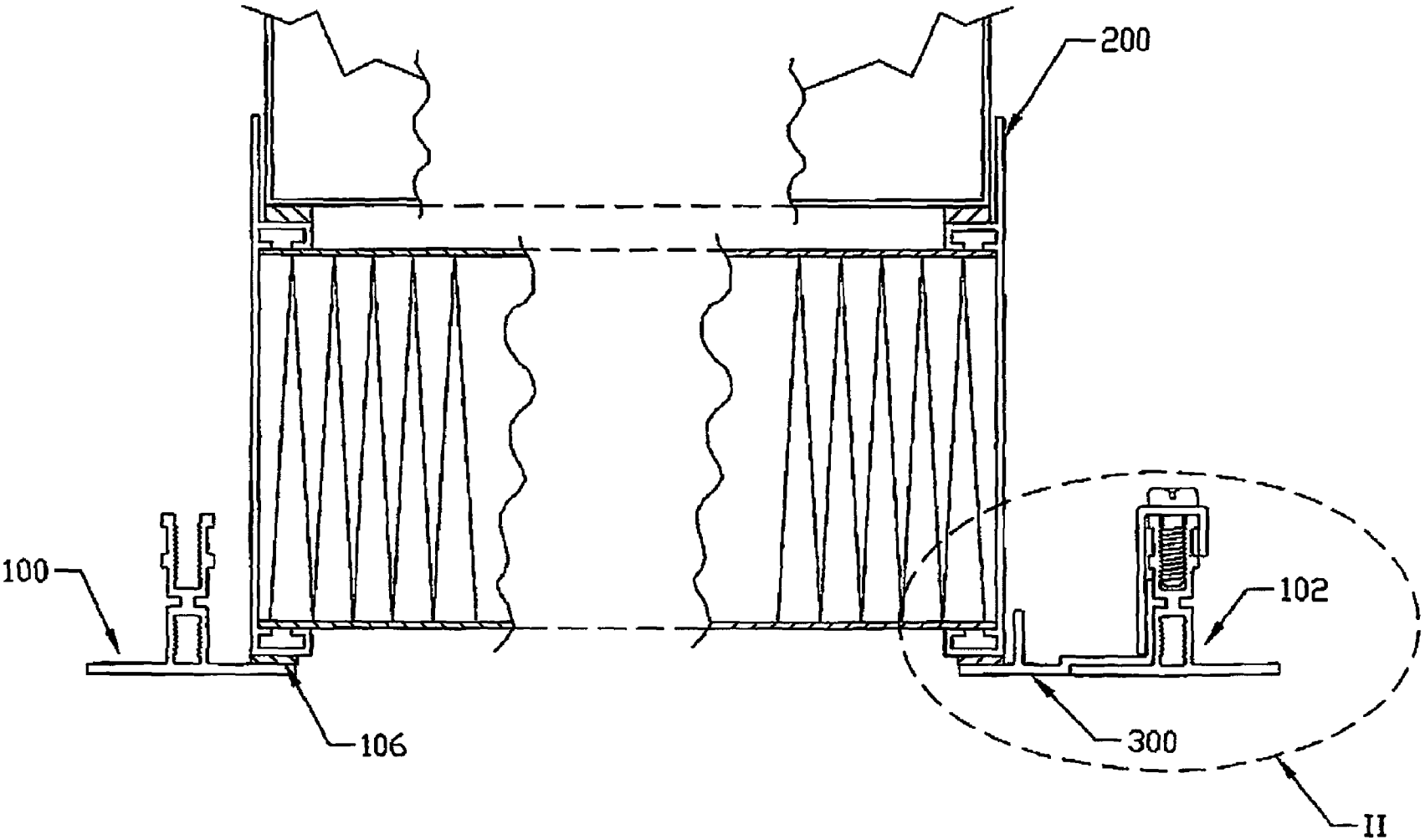
FIG. 1 is a fragmentary cross section view, partially in elevation, of a heavy equipment unit mounted on a suspended grid frame with a first alternative embodiment of a fan filter mounting frame insert of the invention.

Exemplary embodiments of preferred fan filter mounting frames according to the invention are generally shown in the drawing figures and discussed below. More specifically, a first alternative embodiment of the inventive concept is shown in the drawing at FIGS. 1-6. The context of the invention generally includes a suspension frame 100, a piece of mechanical equipment 200 that is to be suspended, and a frame insert 300. The frame insert may be said to adapt one of the suspension frame and the mechanical unit for mounting with the other of the mechanical unit and the suspension frame, respectively.

Various ceiling suspension grid systems 100 and the like are known and useful for suspending mechanical units 200, including fans, filters, lighting, and the like, as is known by one having ordinary skill in the art. Suspension frame systems typically include a series of parallel rails 102 and cross rails 104 (FIG. 3), which install to define the rectangular grid framework 100 that is comprised of an array of included cells.

A casual observer may be most familiar with relatively light duty suspension frame grid systems that are commonly found in offices and homes and the like as suspended ceilings. With regard to light weight equipment components such as acoustical ceiling tiles, some lighting fixtures, and some ventilation grills, the various components may be selectively sequentially placed so the tiles, fixtures, or grills may be modularly sized and rest directly upon suspension grid rails and cross rails. As noted above, the components of each of the suspended ceiling and the equipment are relatively easily handled and manipulated in installation and maintenance. Thus, the light weight components of each of the ceiling system and the equipment may be selectively sequentially manipulated and placed with relative ease.

One having ordinary skill in the art is also familiar with heavier duty suspended grid frame systems that support heavier equipment units 200, including ventilation air moving and conditioning equipment, for example, which may commonly be excessively heavy for convenient manipulation, handling, or placement by an installer or service person. The size or weight of heavier equipment components preclude easy or convenient manipulation of the heavy equipment near an installed position, while suspension frame rail components are selectively removed, positioned, or replaced. Thus, an alternative and safer situation with regard to heavy equipment placement is desired and provided by the invention, in which the suspension frame grid frame system 100 may preferably be undisturbed in its finished design condition; the suspension frame grid and the heavy equipment unit are compatibly sized so the equipment unit slips through a selected cell of the grid, between the rails 102 and cross rails 104 that define the cell; spacers, or inserts, 300 are adapted to insert between the equipment and the grid frame rails and cross rails.

Figure 3:
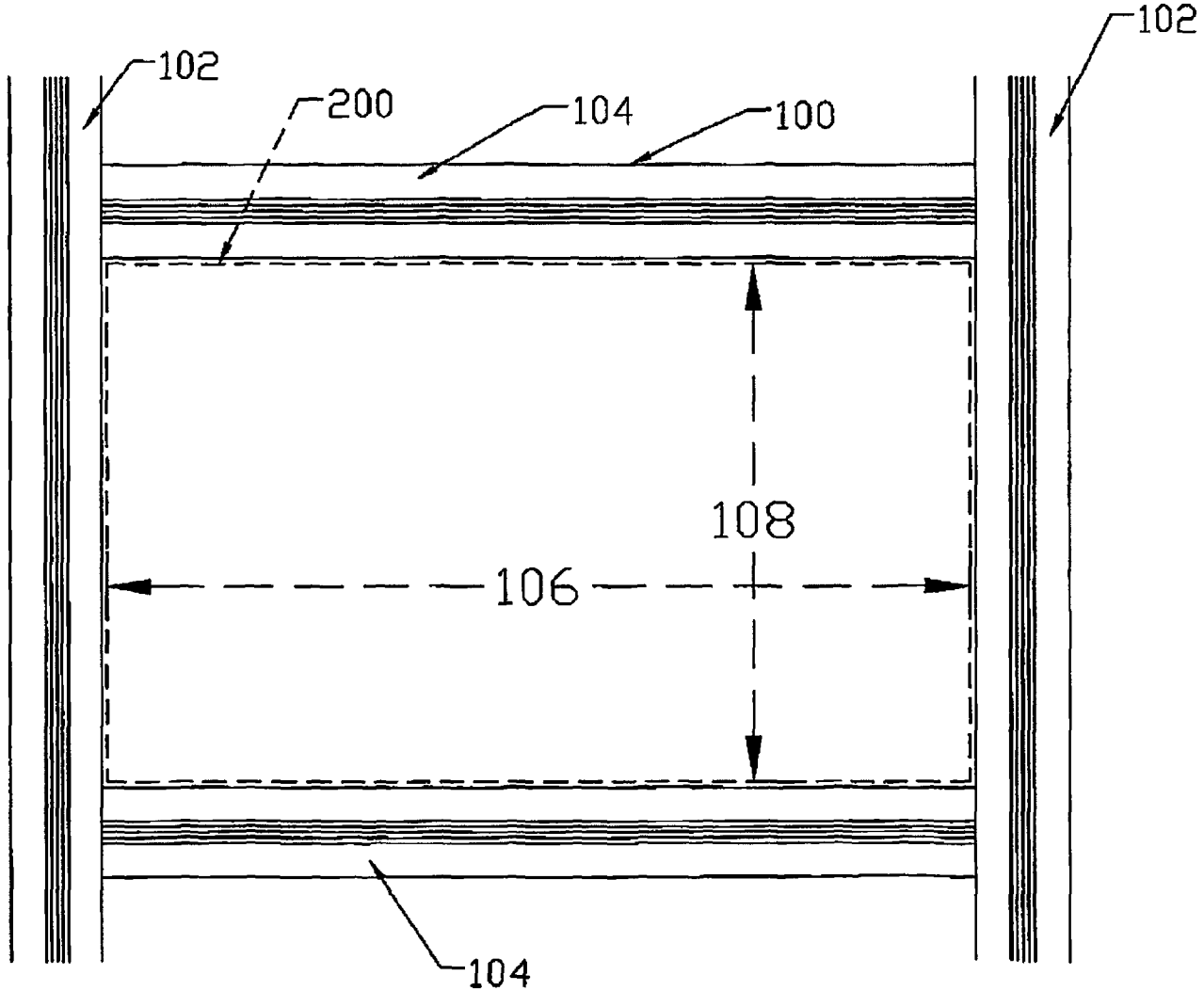
FIG. 3 is a fragmentary top plan view of the suspended T-grid frame of FIG. 1, showing a grid opening and showing in phantom an outline in the grid opening of a housing of the equipment unit.

More specifically, the grid rails 102 are commonly spaced and define an uniform or modular opening length 106, while the grid cross rails 104 are spaced and define an uniform or modular opening width 108, for example, of each cell. The cooperating equipment 200 has a housing, a mounting frame, or other outside dimensions that are slightly smaller than the suspension grid opening length and width. Thus, the equipment may slip fit through the suspension grid opening of a pre-selected cell without disturbing the grid frame (FIG. 3).

Figure 2:
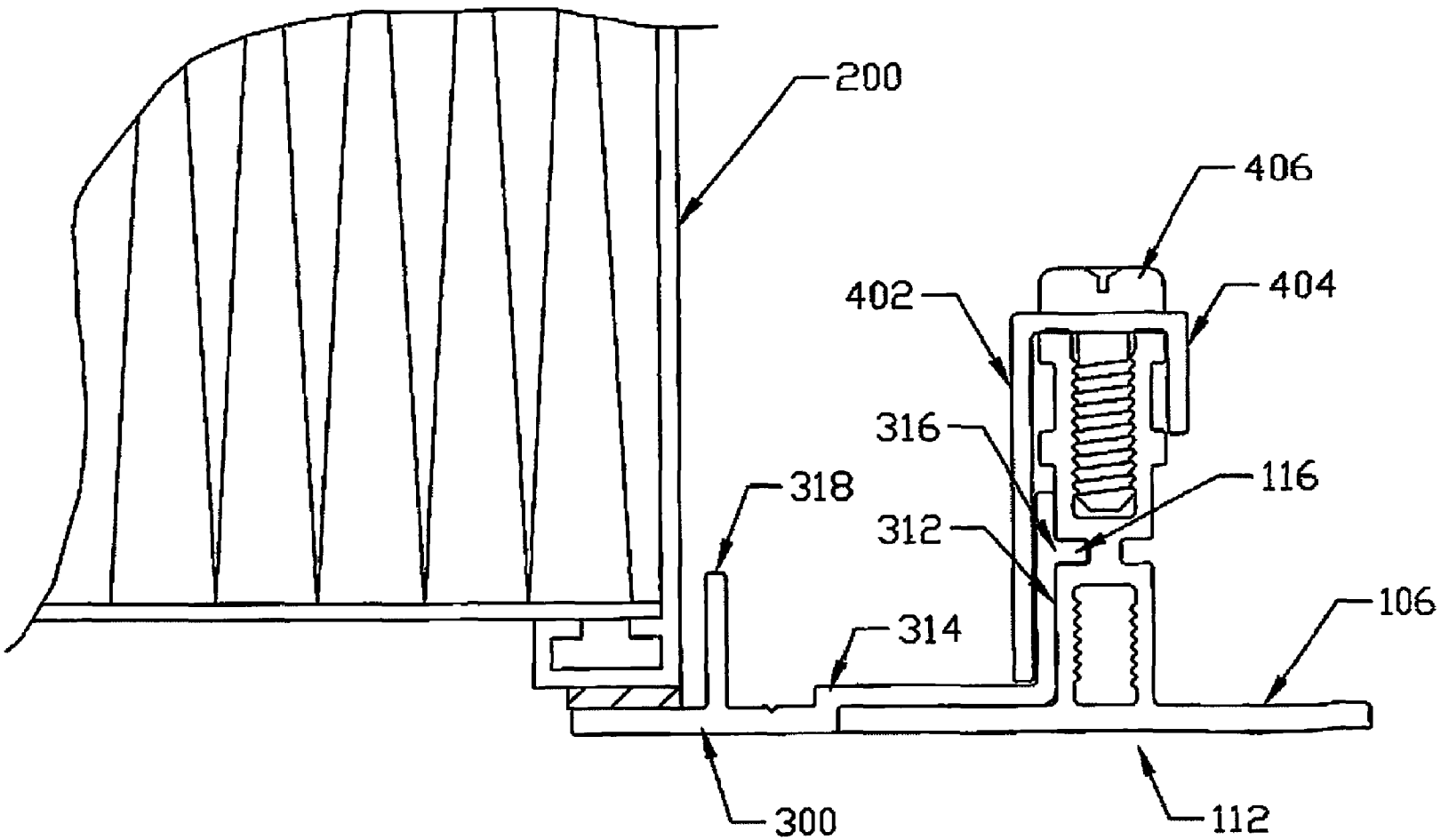
FIG. 2 is an enlarged view of Detail II of FIG. 1, showing a first embodiment of the invention.
Figure 4:
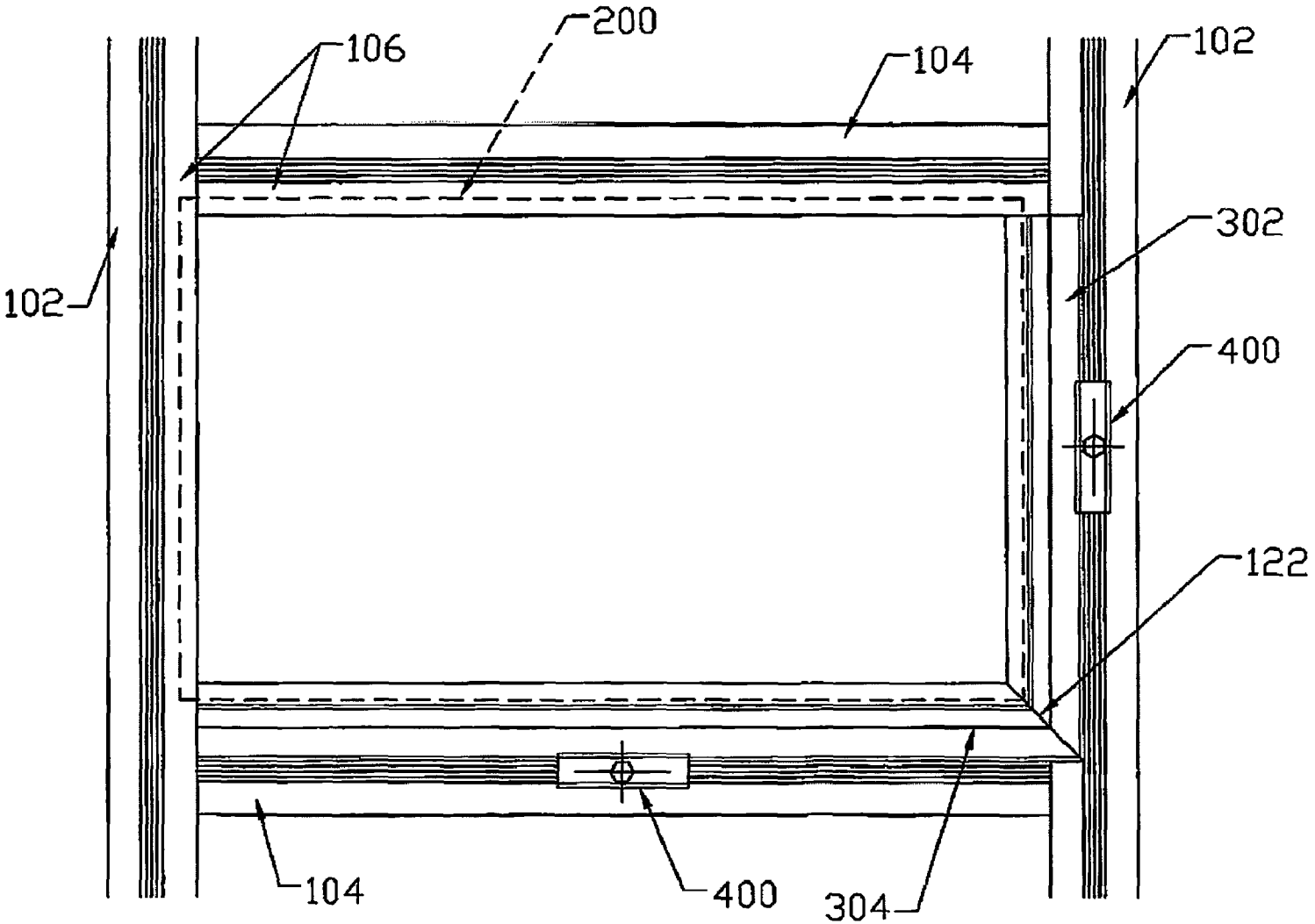
FIG. 4 is the view of FIG. 3, showing the equipment unit positioned in one corner of the grid cell, supported by two adjacent rails of the grid frame in that corner, and supported by a fan filter mounting frame insert of the invention in an opposing corner of the grid cell, with clamp brackets securing the mounting frame insert.

Once through the grid frame opening, the equipment may be positioned into a selected corner of the grid cell, which is commonly defined by a rail 102 and an adjacent cross rail 104. The equipment unit is set to rest upon rail and cross rail support surfaces 106 of the frame components that define the selected corner (FIGS. 4, 1, & 2).

As is generally shown in the drawing and known in the art, the rails 102 and cross rails 104 of the suspension grid frame 100 commonly define modular uniform cells that are typically rectangular and may include the special geometry of the equilateral rectangle that is known as a square. Thus, the geometry of each cell includes having four corners and having 180 degree rotation symmetry. The square is noted to have 90 degree rotation symmetry as well. Thus, the particular corner of the grid cell that is chosen for supporting the unit 200 as disclosed above is substantially immaterial relative to the invention because the inherent symmetries of the geometry of the rectangular cell. Placement of the unit 200 in a selected corner of the cell leaves a gap between the equipment and the diagonally opposing cell corner, including the adjacent rail and cross rail 102 and 104 that define the opposing cell corner.

The adapting spacers 300, including legs or discrete inserts 302 and 304, of the invention come into play to bridge the gaps between the unit 200 and the adjoining rail and cross rail. The adapting spacers are configured to interconnect between the equipment 200 and the frame rail 102 and cross rail 104, providing support surfaces for two adjacent sides of the equipment that are not supported by the diagonally opposing grid frame rail and cross rail. As shown, the inserts 302 and 304 may be adapted with and abut at mitered ends (FIG. 4). The mitered joint 122 may optionally be fixed with welding or the like as may be appropriate to the structural material selected for fabrication of the inserts. Alternatively, the inserts may remain separate parts that extend along adjacent sides of the grid opening and merely abut at the mitered corner 122.

Figure 5:
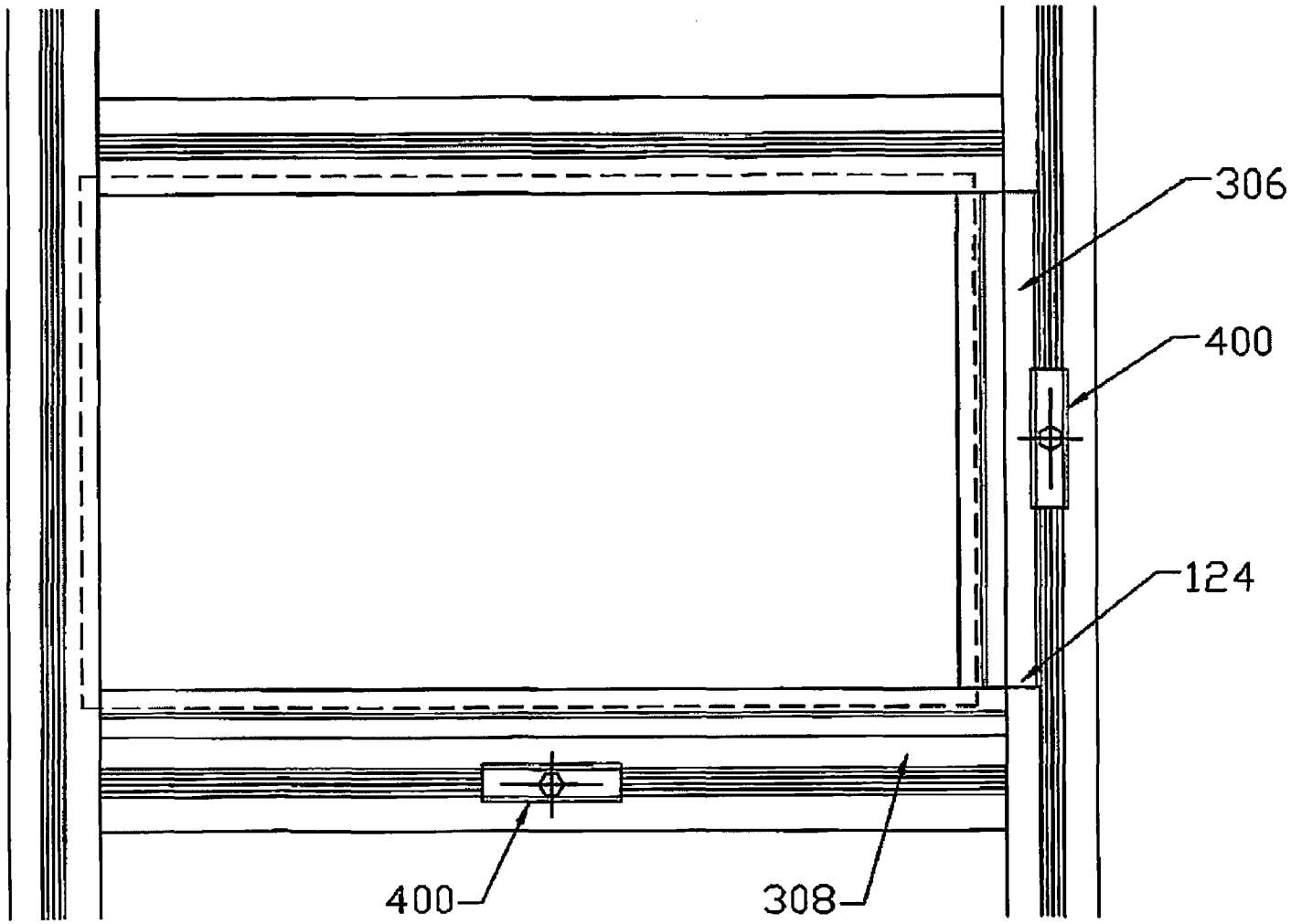
FIG. 5 is the view of FIG. 4, showing an optional alternative configuration of the mounting frame insert.

In an optional alternative, ended inserts 306 and 308 may meet in the corner at a simple butt joint 124 (FIG. 5). One having ordinary skill in the art will notice that the mitering of the inserts 302 and 304 more readily lend them to a strong fixed joint of a one piece insert with legs 302 and 304. On the other hand, the square end inserts 306 and 308 maintain flexibility without regard to which corner of the cell the unit 200 is placed.

The various inserts 302-306 are preferably clamped with their respective rail 102 and cross rail 104. Thus, a clamp 400 that cooperates with the grid rails and cross rails may be provided and fasten the adapting spacers to the grid rails, supporting the equipment (FIGS. 1, 2, 4, and 5). In an exemplary embodiment, the inserts 302-306 may be configured as a stylized L-section angle with legs 312 and 314 (FIGS. 1 & 2). One having ordinary skill in the art knows that suspension grid frame rails are typically lengths of T-shaped members, having a flange 112 that is commonly exposed and a stem 114 that commonly extends upward from the flange to a terminal end (FIG. 2). As shown, an insert 300 may be positioned against the rail with the leg 312 against the stem 114 and the leg 314 against and extending beyond the flange 112. The clamp 400 may then be provided in one embodiment with a clamp leg 402 against the insert leg 312 and capturing the insert leg between the clamp leg and the rail stem 114. The clamp may further have a flange 404 that abuts a terminal end of the stem. A self taping screw or bolt 406 or the like may be used to secure the clamp in position as one having ordinary skill in the art will understand. In various installation circumstances, the clamp may be alternatively configured, including fabrication as a J-channel and as a U-channel.

For various structural and other design consideration, the insert 300 may preferably include a stiffening or locking rib 316 along leg 312, that may key into a cooperating groove 116 in the rail stem 114 (FIG. 2). The insert leg 314 may preferably be styled to be flush with an exposed surface of the rail flange 112. The leg 314 may also include a stabilizing rib 318, which may strengthen the insert 300 or may position the unit 200. Alternatively, the insert 300 may desirably be fastened with the equipment, rather than the suspension grid frame rail as is discussed further below.

Figure 6:
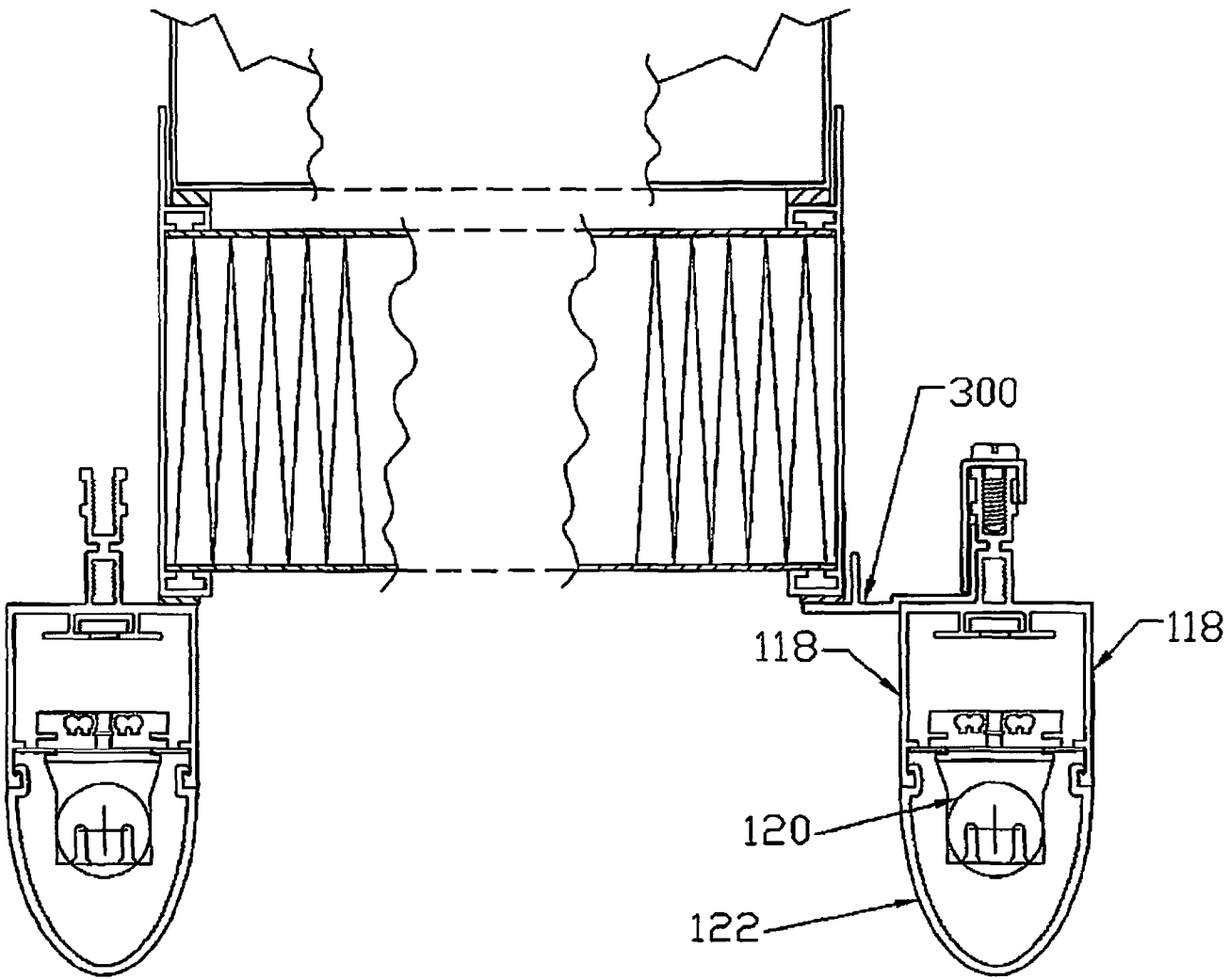
FIG. 6 is the view of FIG. 1, showing optional alternative suspended grid frame rails that include adaptation for a lighting provision.

Various of the rails or cross rails may optionally be adapted to cooperate with a lighting fixture or the like (FIG. 6). The rail flange may be modified with a pair of parallel legs 118 that may extend downward from the flange as shown and define the flange portion as a downward opening U-channel. The legs 118 may extend to terminal ends that are adapted to support a cooperating light fixture 120. Further the leg ends may include adaptation to support a cooperating light shade 122.

Figure 7:
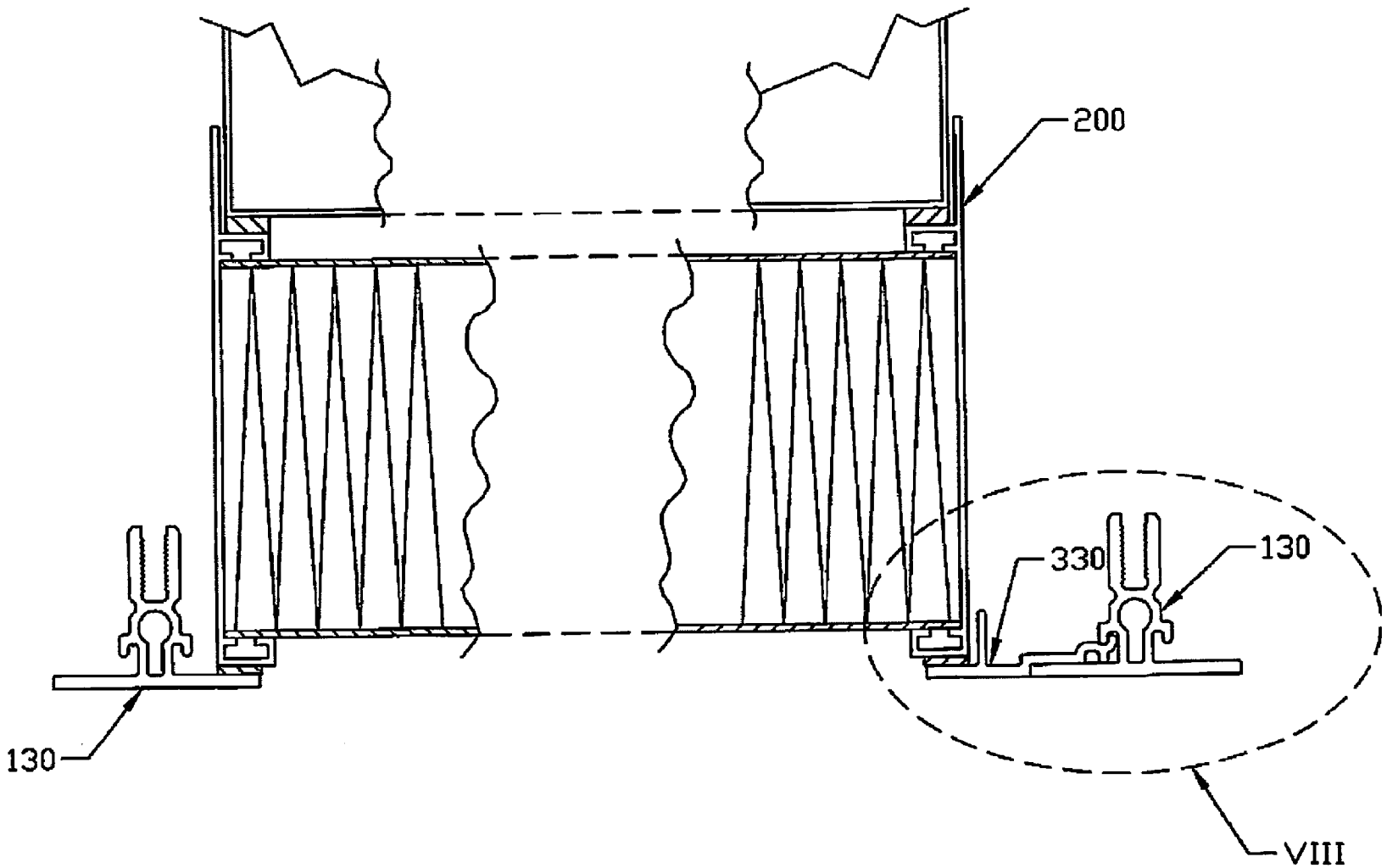
FIG. 7 is the view of FIG. 1, showing a second alternative embodiment of a fan filter mounting frame insert of the invention.
Figure 8:
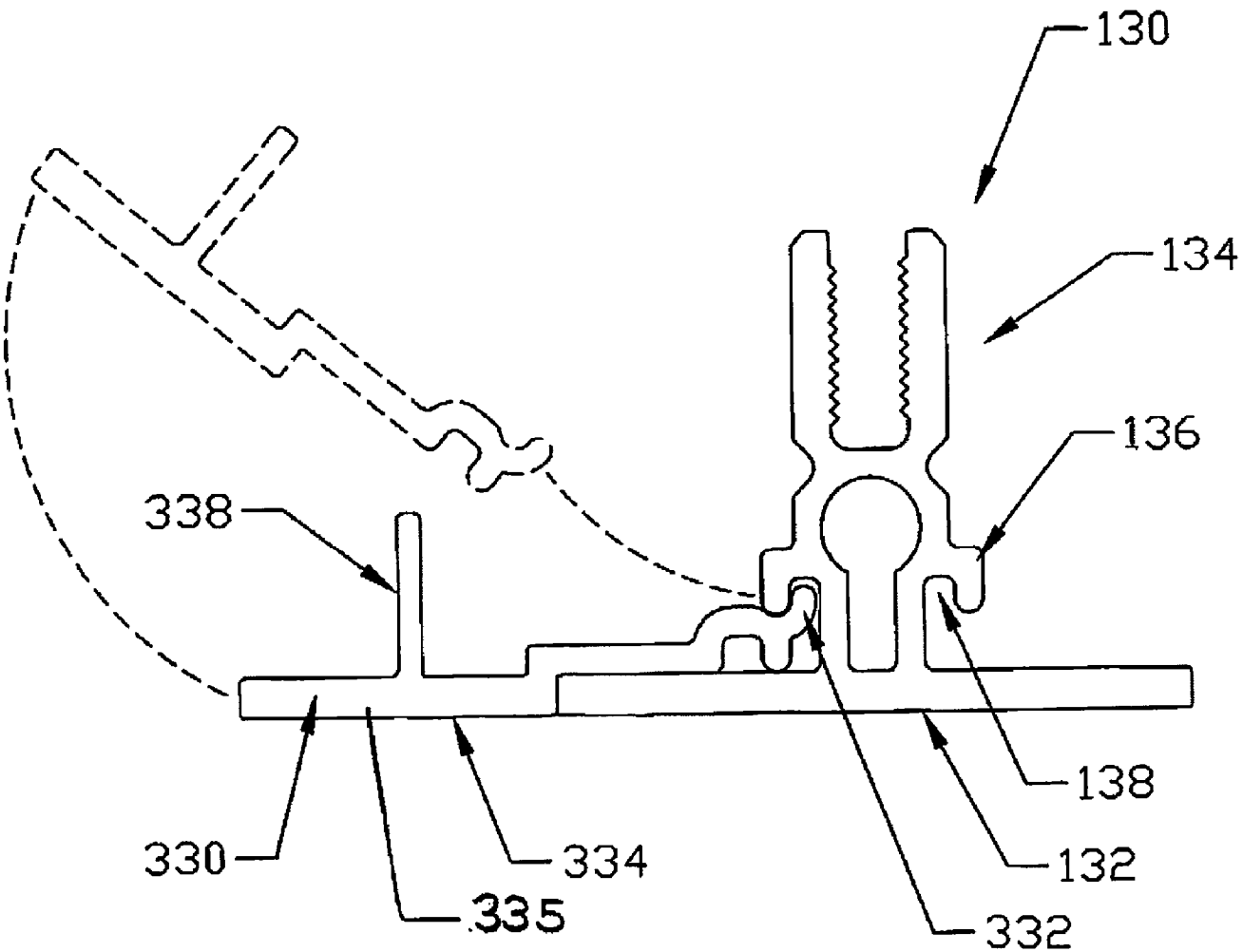
FIG. 8 is a fragmentary enlarged view of Detail VIII of FIG. 7.
Figure 9:
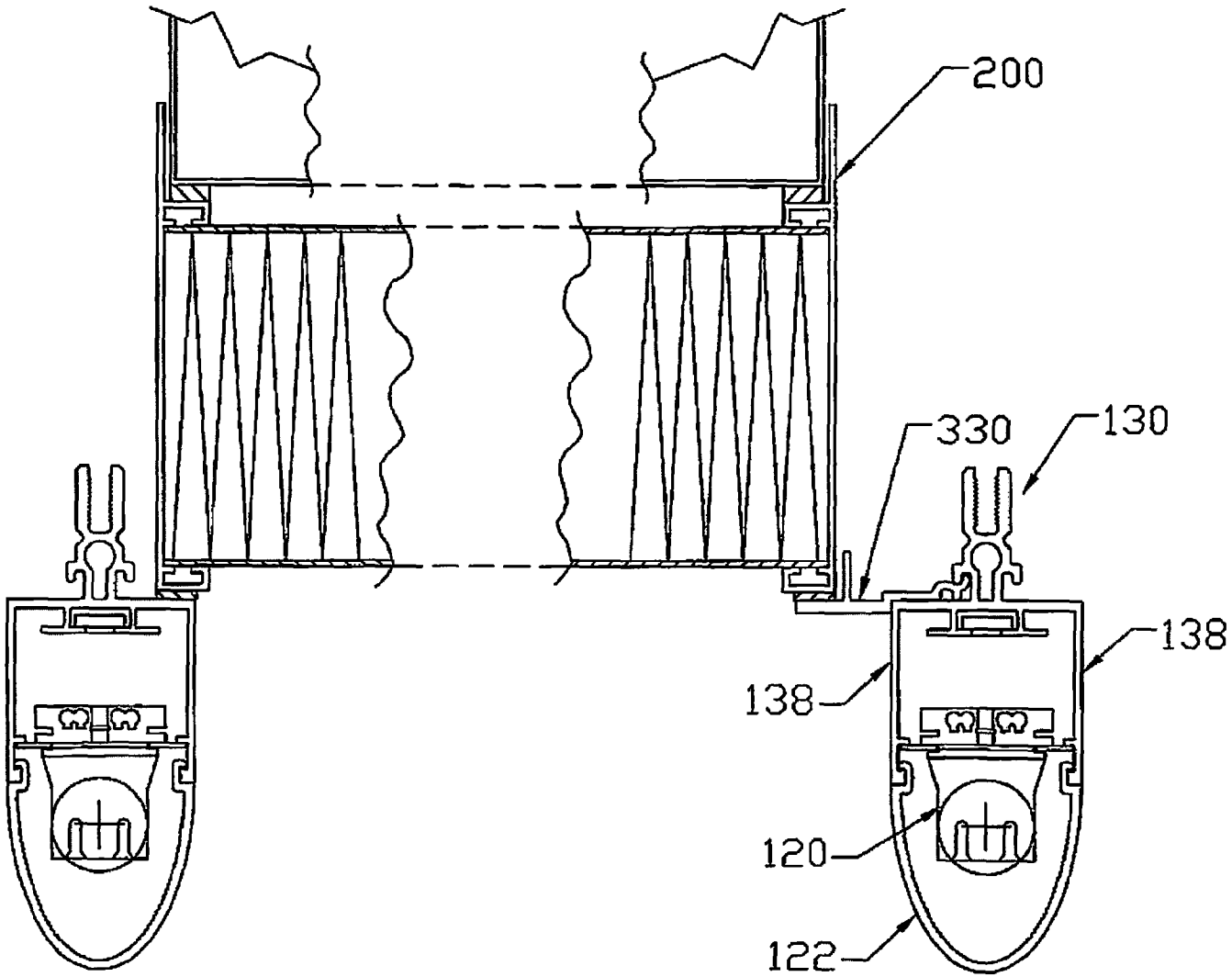
FIG. 9 is the view of FIG. 7, showing optional alternative suspended grid frame rails that include adaptation for a lighting provision.
Figure 10:
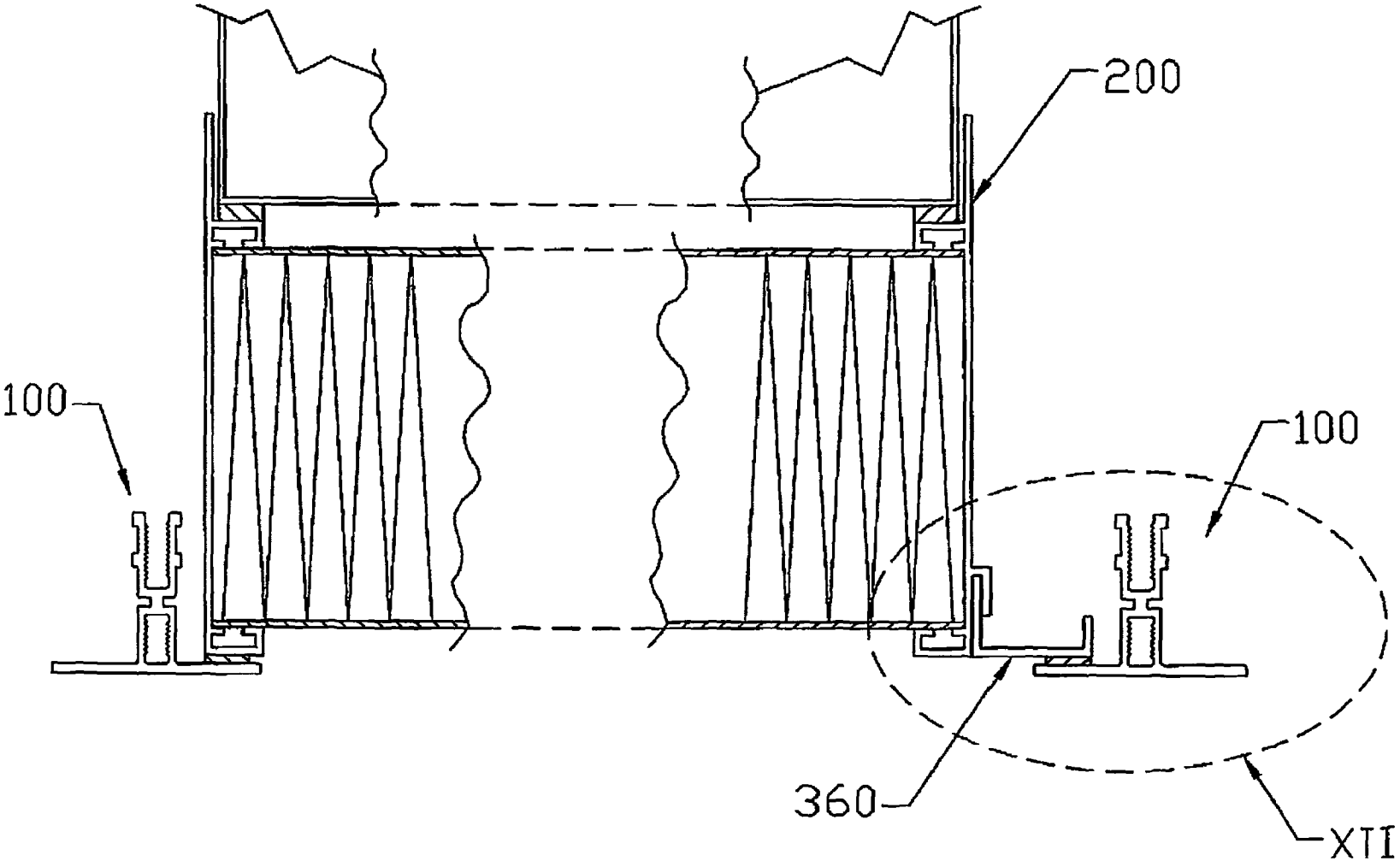
FIG. 10 is the view of FIG. 1, showing a third alternative embodiment of a fan filter mounting frame insert of the invention.
Figure 11:
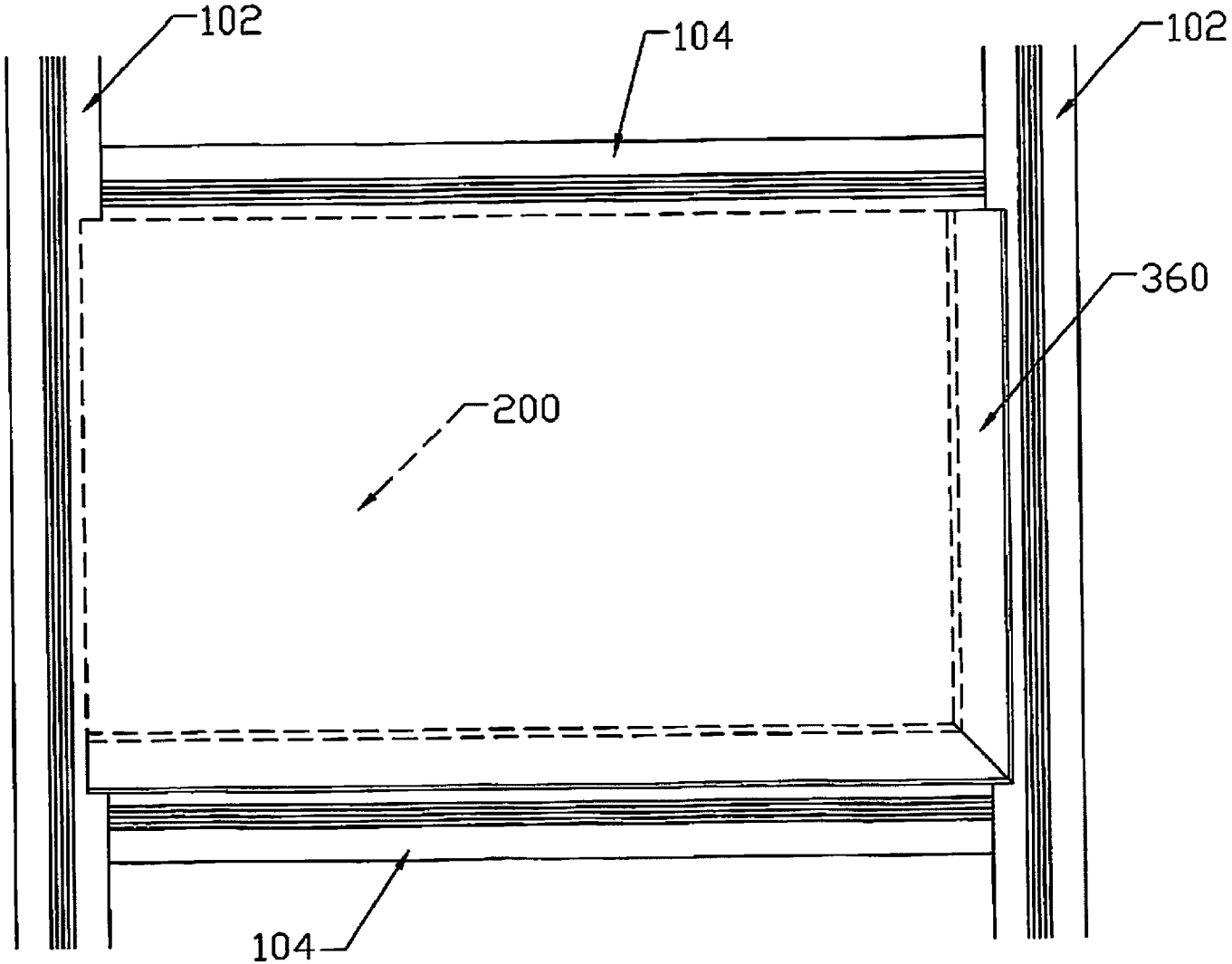
FIG. 11 is a fragmentary top plan view of the suspended T-grid frame of FIG. 10, showing a grid opening and showing in phantom an outline a housing of a heavy equipment unit, the equipment unit is positioned in one corner of the grid cell, supported by two adjacent rails of the grid frame in that corner, and supported in an opposing corner of the grid cell by a fan filter mounting frame insert of the invention according to the third embodiment.
Figure 12:
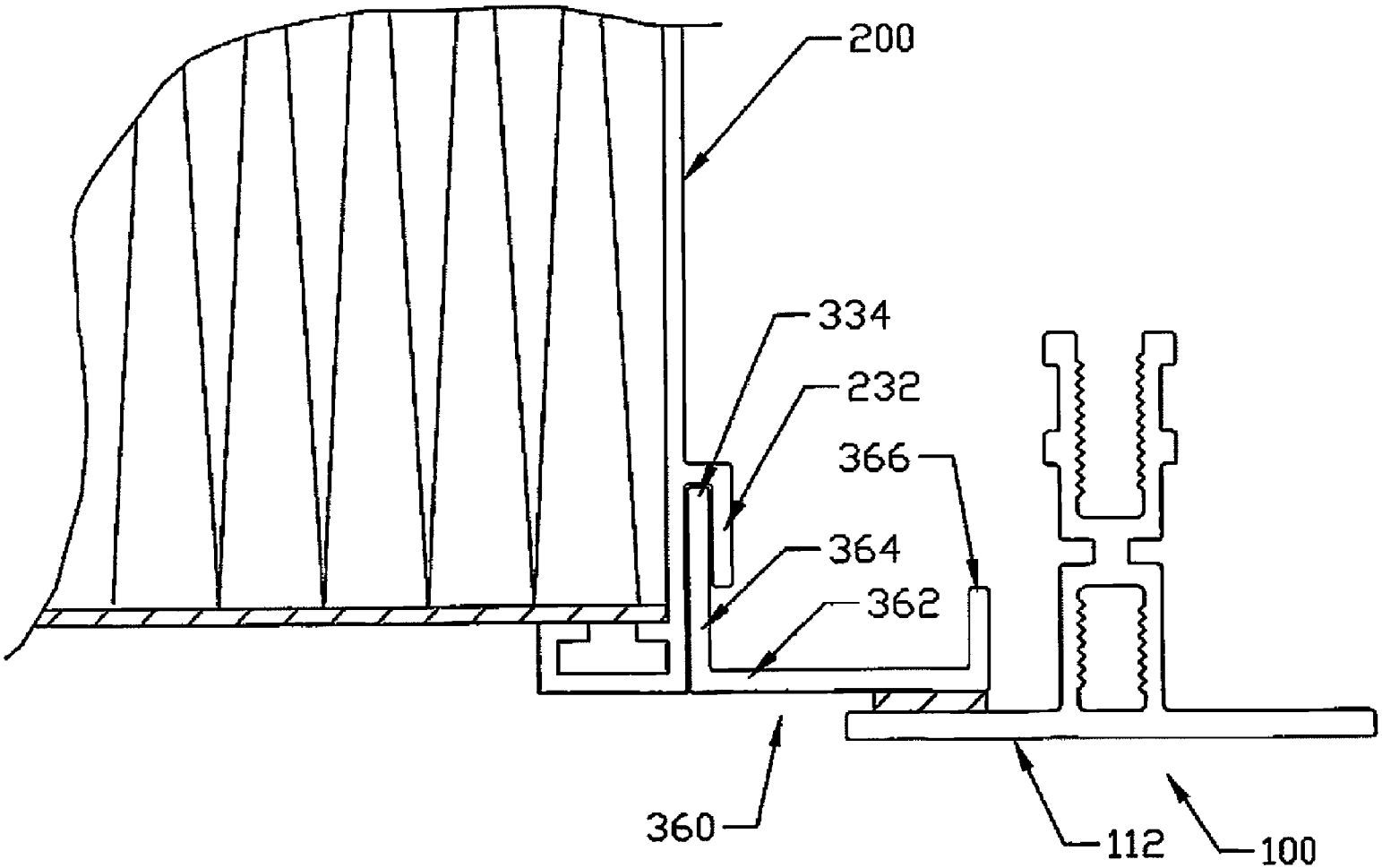
FIG. 12 is an enlarged view of Detail XII of FIG. 11.

In a second alternative embodiment of an example of the invention, the suspension frame grid rails and cross rails (either 130) may have a modified T-section that is adapted with a flange 136 to cooperate with a modified spacer 330 (FIGS. 7-9). The T-rail 130 has a flange 132 and a stem 134. The stem is provided with the downward extending flange 136 that defines a groove 138, which extends along a length of the stem 134.

The insert 330 includes a generally horizontal leg 334 that extends along and beyond the T-rail flange 132, from the stem 134, to support the unit 200. An offset outer end 335 of leg 334 positions the support surface of leg 334 at the same plane as flanges 132 of T-rails 130. The insert 330 may be said to be a modification of the insert 300 in that the insert 300 leg 312 is foreshortened to the insert 330 leg 332. The leg 332 interconnects with the flange 136 and seats in the groove 138 in interlocking engagement. The leg 332 may preferably be configured with a grooved terminal end as shown, which grooved terminal enhancing alignment, placement, and stability of the insert 330.

An advantage of the insert 330 having the lip or leg 332 instead of the short leg 312 is that the stem 134 of the suspension frame rail may be relatively shorter. The shorter stem 134 has various architectural and structural advantages, including requiring less overhead space and requiring less material in fabrication.

The modified rail 130 may optionally be adapted to include incorporation of a lighting fixture (FIG. 9), similar to the discussion above regarding the rail 102 or cross rail 104 (FIG. 6). The rail flange 132 may be modified with a pair of parallel legs 138 that may extend downward from the flange as shown and define the flange portion as a downward opening U-channel. The legs 138 may extend to terminal ends that are adapted to support a cooperating light fixture 120. Further the leg ends may include adaptation to support a cooperating light shade 122.

In a third alternative configuration of the invention, adapting spacers or inserts 360 are structurally secured with the equipment 200, rather than with the suspension frame grid rail 160 (FIGS. 10-13). More specifically, a downward extending flange 232 may be provided on the equipment housing and adapted to define a downward opening groove 234 along the unit 200. A corresponding insert 360 may be configured generally as an angle, a U-channel or a J-channel as shown.

The insert 360 has a bight portion 362 with generally parallel legs 364 and 366 extending in the same direction, upward as shown, from opposite edges of the bight portion 302. The leg 364 is captured in the groove 234 in the example. The insert 360 so positioned, extends to overlay the flange 112 of the respective rail 100, with the bight portion 362 and leg 366. As discussed above relative to the spacer 300 of the first alternative embodiment, the spacer 360 may be one piece with two legs that extend along adjacent lengths of rail 102 and cross rail 104, and may also be implemented as two inserts that abut at a common corner of a suspension grid frame cell. The legs of the insert 360 may meet at a mitered corner as shown and may alternatively meet at a simple butt joint as noted above regarding the insert 300.

Figure 13:
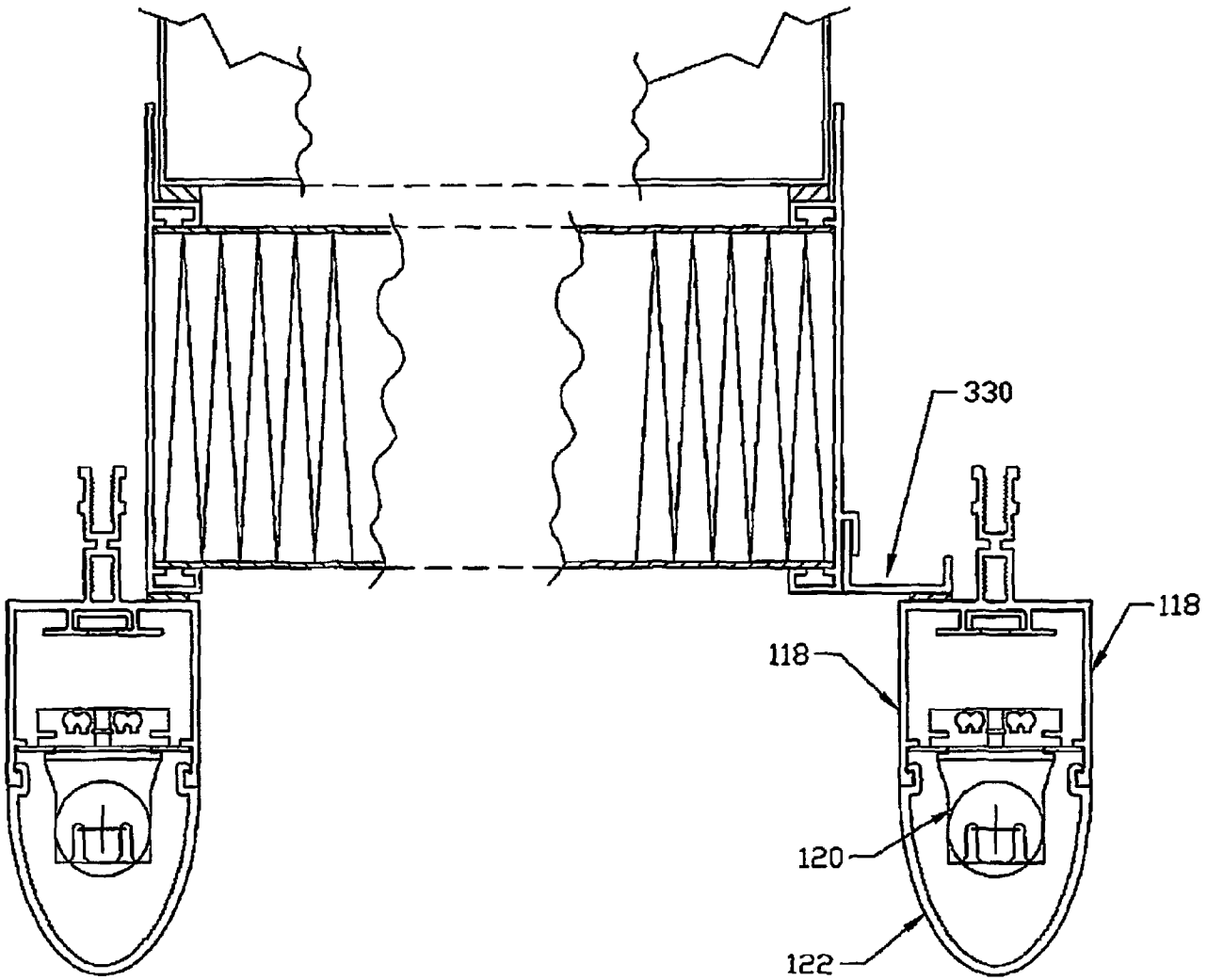
FIG. 13 is the view of FIG. 10, showing optional alternative suspended grid frame rails that include adaptation for a lighting provision.

Various of the rails or cross rails may optionally be adapted to cooperate with a lighting fixture or the like (FIG. 13). The rail flange may be modified with a pair of parallel legs 118 that may extend downward from the flange as shown in the drawing, and define the flange portion as a downward opening U-channel. The legs 118 may extend to terminal ends that are adapted to support a cooperating light fixture 120. Further the leg ends may include adaptation to support a cooperating light shade 122, all as discussed above relative to the first alternative embodiment.

One having ordinary skill in the art and those who practice the invention will understand from this disclosure that various modifications and improvements may be made without departing from the spirit of the disclosed inventive concept. One will also understand that various relational terms, including left, right, front, back, top, and bottom, for example, are used in the detailed description of the invention and in the claims only to convey relative positioning of various elements of the claimed invention.

What is claimed is:

1. In a suspended ceiling system wherein a rectangular equipment unit is mounted in a rectangular equipment opening in a suspension grid system positioned at an elevated position in a room, the suspension grid system comprising a number of rails and cross rails that define a plurality of generally rectangular cells having open interiors, at least one open interior comprising an equipment opening, the rails and cross rails surrounding the equipment opening having generally vertical stems suspended from a ceiling and generally horizontal support flanges extending outwardly from the stems toward an interior of the equipment opening, the equipment opening being sufficiently large that the rectangular equipment unit fits through the equipment opening while horizontally oriented, the improvement wherein:

one corner of the equipment unit is positioned over adjacent flanges of an intersecting rail and cross rail at one corner of the equipment opening, such that the equipment unit rests directly on the respective adjacent flanges of the rail and cross rail adjacent one corner of the equipment opening when oriented for support by the grid system;

a diagonally opposite corner of the equipment unit is spaced laterally away from supporting engagement with adjacent grid support flanges at a second corner of the equipment opening opposite to said one corner, such that without further support said opposite corner of the equipment unit would fall through the equipment opening;

a removable frame insert being positioned over each of the two perpendicular support flanges adjacent the second corner of the equipment opening, each frame insert being positioned such that an outer side thereof engages an upwardly facing surface on the adjacent support flange and an inner side thereof engages a downwardly facing surface on the equipment unit, the frame inserts being formed and attached in the system such that the frame inserts cause the equipment unit to be supported by the support flanges adjacent said second corner, whereby the equipment unit may be installed in the equipment opening by passing the equipment unit upwardly through the equipment opening, moving the equipment unit laterally so that one corner thereof is positioned over the flanges at one corner of the equipment opening, inserting one or more frame inserts into supporting engagement between the support flanges and the equipment unit adjacent the second corner of the equipment opening, and lowering the equipment unit for supporting engagement with the support flanges on the sides adjacent said one corner and with the frame inserts at the sides adjacent said second corner.

2. In a suspended ceiling system wherein a rectangular equipment unit is mounted in a rectangular equipment opening in a suspension grid system positioned at an elevated position in a room, the suspension grid system comprising a number of rails and cross rails that define a plurality of generally rectangular cells having open interiors, at least one open interior comprising an equipment opening, the rails and cross rails surrounding the equipment opening having generally vertical stems suspended from a ceiling and generally horizontal support flanges extending outwardly from the stems toward an interior of the equipment opening, the equipment opening being sufficiently large that the rectangular equipment unit fits through the equipment opening while horizontally oriented, the improvement wherein:

one corner of the equipment unit is positioned over adjacent flanges of an intersecting rail and cross rail at one corner of the equipment opening, such that the equipment unit rests directly on the respective adjacent flanges of the rail and cross rail adjacent said one corner of the equipment opening when oriented for support by the grid system;

a diagonally opposite corner of the equipment unit is spaced laterally away from supporting engagement with adjacent grid support flanges at a second corner of the equipment opening opposite to said one corner of the equipment opening, such that without further support said opposite corner of the equipment unit would fall through the equipment opening, wherein the equipment unit includes downwardly facing recesses at the sides adjacent the opposite corner;

a removable frame insert being positioned over each of the two perpendicular support flanges adjacent said second corner of the equipment opening, the inserts upwardly extending projections at inner sides thereof that fit in supporting engagement with the recesses in the equipment units and having outwardly extending portions that rest on the horizontal flanges on the rails, the frame inserts being formed and attached in the system such that the frame inserts cause the equipment unit to be supported by the support flanges adjacent said second corner, whereby the equipment unit may be installed in the equipment opening by passing the equipment unit upwardly through the equipment opening, moving the equipment unit laterally so that one corner thereof is positioned over the flanges at one corner of the equipment opening, inserting one or more frame inserts into supporting engagement between the support flanges and the equipment unit adjacent the second corner of the equipment opening, and lowering the equipment unit for supporting engagement with the support flanges on the sides adjacent said one corner and with the frame inserts at the sides adjacent said second corner.

3. A suspension ceiling system as in claim 2 wherein the equipment units include downwardly extending support flanges on outer sides thereof, with the support flanges defining downwardly opening grooves along a lower edge thereof, the downwardly opening grooves serving as the downwardly facing recesses.

4. A suspension ceiling as in claim 3 wherein the insert comprises a channel member having a bottom flange that engages the support flange on the suspension grid rail and an upwardly extending leg that fits in the downwardly extending groove in the support flange.

5. A suspension ceiling system as in claim 1 wherein the equipment unit is a fan filter module.

6. A suspension ceiling system as in claim 1 wherein the inserts include movement limiting ribs on an upper surface thereof that prevent the equipment unit from sliding outwardly from said one corner over the insert a sufficient distance that the sides of the equipment unit that rest directly on the rail support flanges at said one corner move out of supporting contact with the support flanges on which they rest.

7. A suspension ceiling system as in claim 1 wherein the removable frame insert comprises a generally horizontal equipment support flange that rests on the rail support flange, with an inner edge fitting under the equipment unit, the insert further having a vertical leg that extends upwardly from the horizontal equipment support flange along a side of the rail stem, the system further including a removable clamp that fits on the rail and holds the vertical leg of the insert to the side of the stem.

8. A suspension ceiling as in claim 7 wherein the clamp includes a downwardly extending leg that abuts the vertical leg of the insert on a side opposite the stem, the clamp further including a releasable fastener that holds the vertical leg of the clamp on the stem so as to hold the insert in position on the rail.

9. A suspension ceiling as in claim 8 wherein the clamp includes a top portion that extends from a top of the vertical leg of the clamp over the top of the rail stem, the releasable fastener including a threaded fastener that extends downwardly through an opening in the top portion and into a thread receiving receptacle in a top of the stem.

10. A suspension ceiling system as in claim 7 wherein the equipment unit is a fan filter module.

11. A suspension ceiling system as in claim 1 wherein the frame inserts comprise a pair of inserts that meet at the second corner of the equipment opening.

12. A suspension ceiling system as in claim 11 wherein the inserts have support flanges that meet in one of a mitered corner joint and a butt corner joint.

13. A suspension ceiling system as in claim 12 wherein the inserts are separable members.

* * * * *